US006374526B1

(12) United States Patent
Mochak

(10) Patent No.: US 6,374,526 B1
(45) Date of Patent: Apr. 23, 2002

(54) FIRING PIN BLOCK FOR PISTOL

(75) Inventor: Richard J. Mochak, Russell, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/573,856

(22) Filed: May 18, 2000

(51) Int. Cl.[7] ..... F41A 17/00
(52) U.S. Cl. ..... 42/70.08
(58) Field of Search ..... 42/70.08

(56) References Cited

U.S. PATENT DOCUMENTS

| | | | | | |
|---|---|---|---|---|---|
| 939,882 | A | * | 11/1909 | Whitting | 89/150 |
| 2,691,232 | A | * | 10/1954 | Hoopes | 42/70.08 |
| 3,656,249 | A | * | 4/1972 | Raville | 42/69.03 |
| 3,722,358 | A | * | 3/1973 | Seecamp | 89/147 |
| 3,750,531 | A | | 8/1973 | Angell et al. | 89/148 |
| 3,830,002 | A | | 8/1974 | Volkmar | 42/70 F |
| 3,964,368 | A | * | 6/1976 | Zimeri Safie | 89/141 |
| 4,021,955 | A | | 5/1977 | Curtis | 42/70 F |
| 4,176,584 | A | * | 12/1979 | Thomas, Jr. et al. | 89/138 |
| 4,306,487 | A | | 12/1981 | Beretta | 89/148 |
| 4,575,963 | A | | 3/1986 | Ruger et al. | 42/70 |
| 4,854,217 | A | * | 8/1989 | Ransom | 89/163 |
| 5,036,612 | A | | 8/1991 | Jennings | 42/70.08 |
| 5,090,147 | A | | 2/1992 | Pastor | 42/70.05 |
| 5,245,776 | A | | 9/1993 | Dornaus | 42/70.08 |
| 5,259,138 | A | | 11/1993 | Scirica | 42/70.08 |
| 5,467,550 | A | | 11/1995 | Mumbleau | 42/70.11 |
| 5,493,806 | A | | 2/1996 | Langevin et al. | 42/69.02 |
| 5,570,527 | A | * | 11/1996 | Felicci | 42/70.08 |
| 5,651,206 | A | * | 7/1997 | Matarazzo | 42/70.08 |
| 5,671,560 | A | | 9/1997 | Meller | 42/70.11 |
| 5,903,994 | A | | 5/1999 | Tange | 42/70.01 |
| 5,924,232 | A | | 7/1999 | Rhoden et al. | 42/70.11 |

* cited by examiner

*Primary Examiner*—Charles T. Jordan
*Assistant Examiner*—Jordan M Lofdahl
(74) *Attorney, Agent, or Firm*—McCormick, Paulding & Huber LLP

(57) ABSTRACT

A firearm having a firing pin block that does not affect trigger pull is disclosed. The firing pin block embodied in the present invention is actuated by a grip safety operably linked to a spring biased locking plunger to prevent accidental discharge of the firearm. An intermediate lever interposed between a grip safety lever and a firing pin locking plunger pivots on the hammer stud to reposition the plunger from the locked to the unlocked position only when the grip safety is properly depressed.

4 Claims, 3 Drawing Sheets

FIRING PIN BLOCK FOR PISTOL

FIELD OF THE INVENTION

The present invention relates generally to firearms safeties and more particularly to a firing pin block for a pistol.

BACKGROUND OF THE INVENTION

Various types of firing pin blocks are known in the prior art. U.S. Pat. No. 5,259,138 for "FIRING PIN MECHANISM BLOCKING SYSTEM", assigned to Colt's Manufacturing Company, Inc., discloses a safety mechanism for a firearm to prevent the firearm from firing except when the trigger has been moved to a predetermined position. The mechanism includes a plunger and a blocker. The blocker is movably mounted to the slide at a position in front of a striker to prevent the striker from moving forward to strike a cartridge. The plunger is movably mounted to a portion of the frame and is adapted to be moved by the trigger. The plunger, in turn, is adapted to move the blocker to allow a clear path for the striker to move forward to strike a cartridge.

U.S. Pat. No. 4,575,963 for "PISTOL MECHANISM FOR BLOCKING FIRING PIN", assigned to Sturm, Ruger & Company, Inc., discloses a frame-mounted firing pin blocking piece for blocking a semi-automatic pistol firing pin which blocking piece is rotated to its unblocking position by action of a trigger bar which bar is in turn positioned by the trigger and the firearm slide. A sear associated with the firing pin blocking piece permits such operation in single action, double action and re-set modes.

U.S. Pat. No. 4,021,955 for "FIRING PIN LOCKING DEVICE AND METHOD", assigned to Colt Industries Operating Corporation, discloses a semiautomatic pistol having a frame which supports a barrel and breech-slide for chambering a cartridge in the breech end of the barrel and extracting a spent cartridge. The breech-slide carries an inertia type firing pin which is displaced to fire a chambered cartridge by a hammer pivotally mounted upon the frame. A trigger bar, mounted upon a trigger displaces a sear to release the hammer when the trigger is pulled. A breech-slide operated disconnect causes pivoting of the trigger bar as the breech-slide recoils to allow the sear to snap back to a position in which it can engage the searing surface of the hammer when the breech-slide moves forwardly.

In the '955 patent a firing pin lock is biased to a position where the pin is free to travel under the impetus of a falling hammer. The upper surface of a pivotally mounted shell ejector normally engages the firing pin lock to maintain it in a position where the firing pin is locked. When the trigger is pulled to release the cocked hammer, the trigger bar simultaneously pivots the ejector out of engagement with the firing pin lock, which action unlocks the firing pin. The pivoting of the trigger bar by the disconnect frees the ejector from the trigger bar, allowing a spring to return the ejector to its former position in which the firing pin will be locked as the breech-slide moves forwardly into battery position. This arrangement prevents accidental discharge of the firearm by displacement of the firing pin as may be occasioned by dropping the firearm on the muzzle end or on the hammer.

U.S. Pat. No. 4,843,748 for "FIREARM", assigned to ITM Industrial Technology & Machines AG., discloses a locking plunger which is perpendicularly movable relative to the direction of movement of the firing pin to allow or prevent the axial movement of the firing pin to fire the gun. This locking plunger is spring biased to abut a safety lever which is part of the sear of the operating members of the gun. The safety lever is located and arranged such on the sear that it allows a movement of the locking plunger into the firing pin unlocking position upon the operating members of the gun reaching the end of the trigger slack. Accordingly a movement of the locking plunger into the unlocking position will proceed not earlier than the sear snapping into the firing position. Any other accidental limited movements of the operating parts of the gun including such of the hammer cannot cause an axial movement of the firing pin because such movement is positively prevented by the locking plunger. Therefore, an accidental firing of the gun is positively prevented.

A common element in each of these firing pin block designs is that they are trigger actuated and therefore may affect trigger pull. For precision shooting, where a crisp even trigger pull is critical, such designs are particularly disadvantageous.

Also disclosed in the prior art are firing pin blocks actuated by a grip safety, such as the grip safety shown in U.S. Pat. No. 5,036,612 for "GRIP SAFETY FOR PISTOL". The '612 patent discloses a pistol safety catch and release mechanism for selectively restraining a firing pin in its inoperative position until released by a lever and linkage mechanism operatively mounted in the handgrip of the pistol. In one version, a vertical movable sear is moved into and out of a blocking position with respect to the firing pin that is moved between these positions by the pivotal action of a grip lever pivotally carried at one end to the handgrip. An intermediate link includes a slot through which a pin travels carried on the grip lever causing the intermediate link to pivot. An end of the intermediate link fits into a notch on a slide bar so that the slide bar moves back and forth in response to actuation of the grip lever via the intermediate link. The sear moves to its blocking position when on top of the slide bar while in its non-blocking or release position when occupying an end notch in the slide bar.

The mechanical linkage of the grip safety disclosed in the '612 patent is relatively complex, having both an intermediate link and a slide bar.

OBJECTS AND SUMMARY OF THE INVENTION

The present invention provides a mechanism to block the accidental firing of a firearm. A two position spring loaded plunger is continuously placed between the firing pin and a chambered round except when the firearm is in use and the grip safety is fully depressed. Plunger motion is controlled by a lever activated by a standard grip safety.

It is a primary objective of the present invention to provide a firing pin block for single action pistols that does not compromise trigger pull. This objective is accomplished by employing the grip safety rather than the trigger to control the position of the plunger.

It is a further objective of the present invention to provide a simplified firing pin block that does not compromise trigger pull.

DETAILED DESCRIPTION OF THE PREFERRED EMBODIMENT

Figure 1:
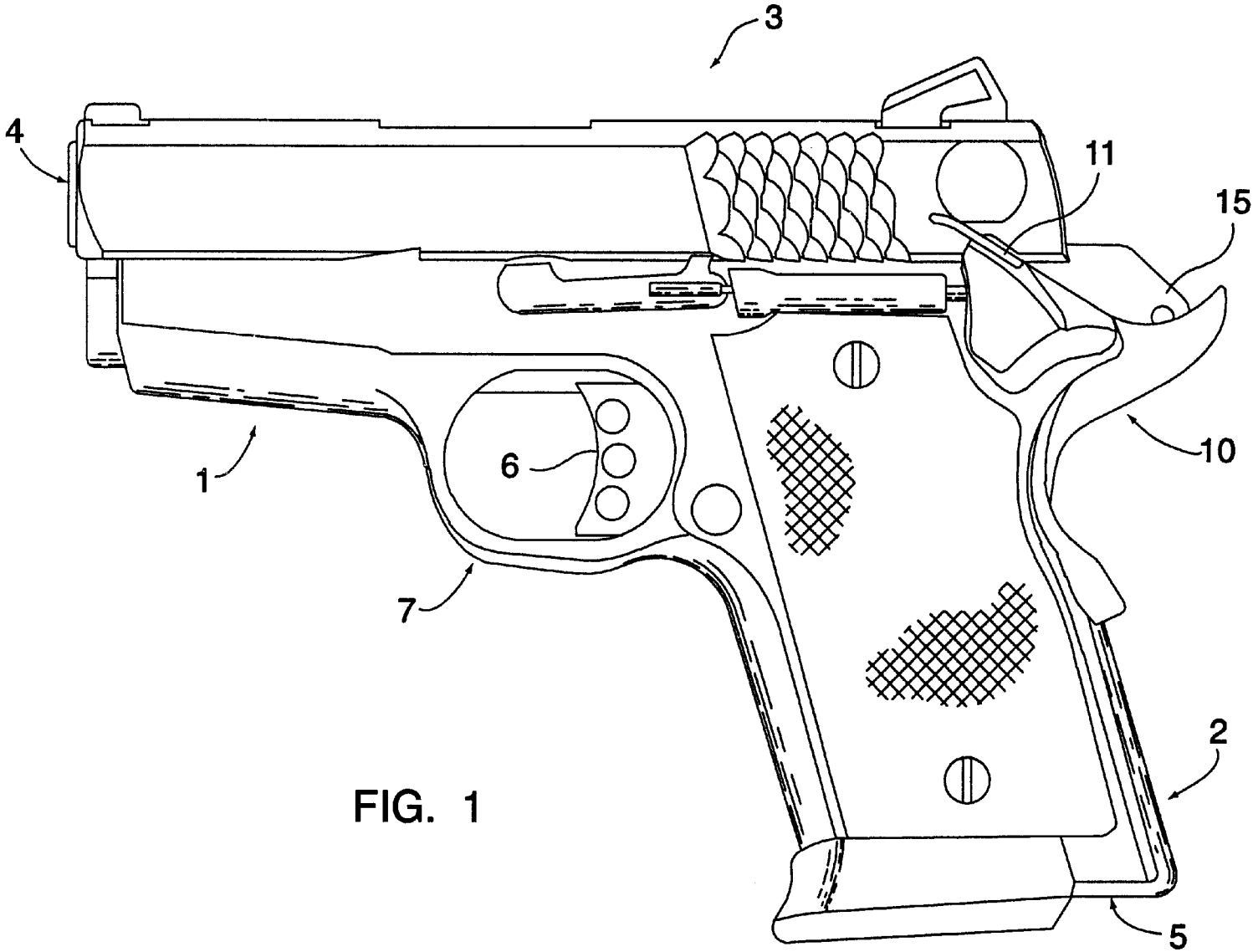
FIG. 1 is a schematic side view of a semiautomatic pistol of the present invention.

Referring to FIG. 1, a semi-automatic pistol is shown. The pistol is generally of a design commonly known to a person skilled in the art. Such a pistol typically has a frame 1 with grip portion 2 and a breech-slide 3 with breech block moveably connected to the frame for forward and rearward movement relative to the frame and breech-slide. A barrel 4 mounted on top of the frame has a chamber portion for holding a cartridge. A magazine 5 for holding multiple cartridges and for feeding the cartridges by a follower and spring into the chamber responsive to the movement of the breech-slide is removably inserted into a magazine receiver within the grip of the pistol. The pistol typically has a hammer 15 for striking a firing pin which in turn can strike the primer of a cartridge within the chamber and a main-spring for biasing the hammer toward the firing pin. A pivotably movable trigger 6 connected to a trigger bar that cooperates with mechanical linkage to cause the firing pin to strike the primer of the cartridge is positioned within a trigger guard 7. An extractor and an ejector system for ejecting a spent shell or casing from the open breech and a reaction or recoil spring for returning the breech-slide to a forward and breech closed position after the pistol has been fired are common features. Safety mechanisms typically include a grip safety 10, which normally locks the trigger 6 or otherwise prevents discharge of a cartridge until the grip 2 of the pistol is properly grasped, and a thumb lever safety 11 for locking the trigger 6 and other cartridge firing components when pivoted into the on-safe position.

Figure 2:
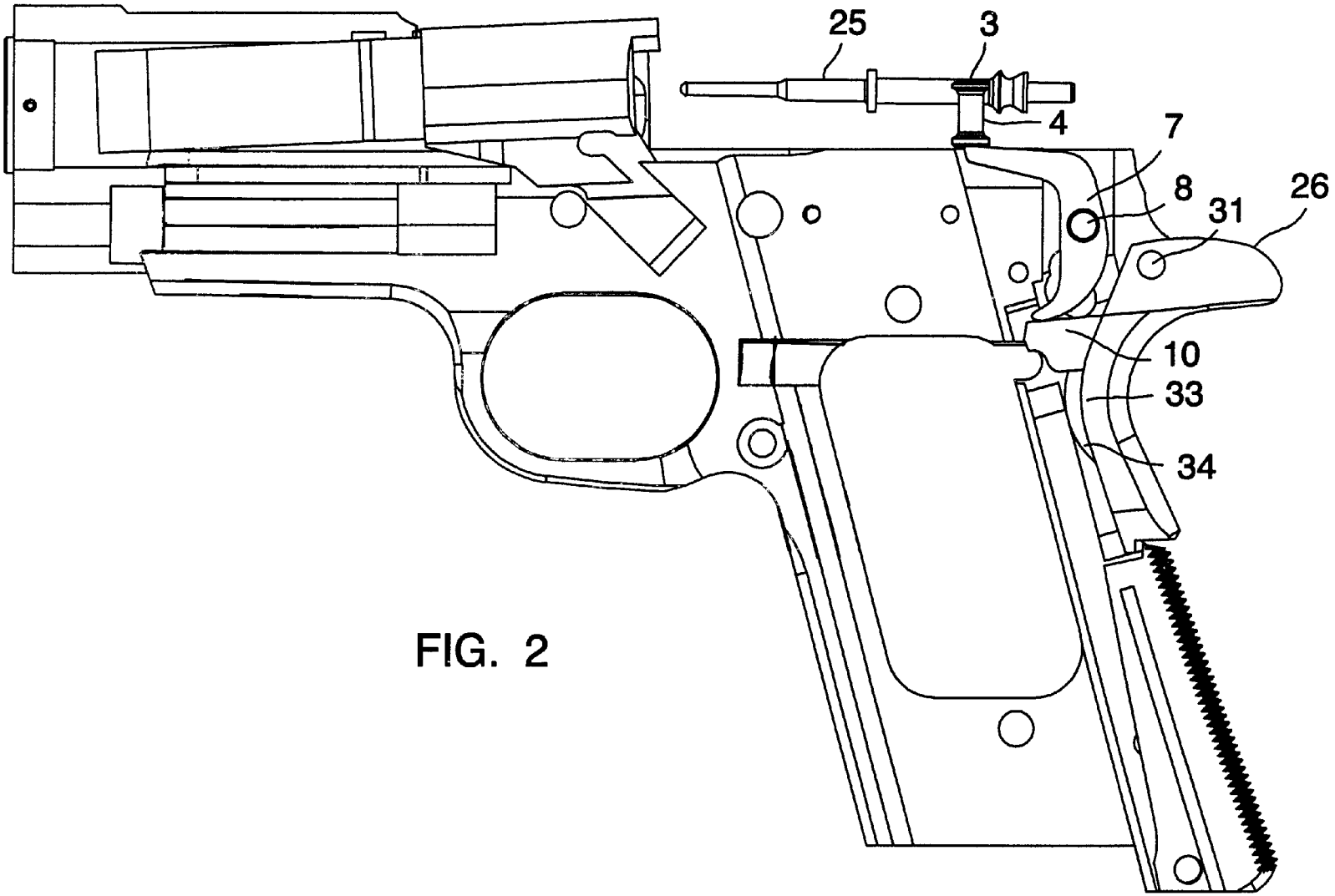
FIG. 2 is a side elevational view, partly in section, of the pistol of FIG. 1 showing the firing pin in the "Blocked Condition"

Referring to FIG. 2, in the preferred embodiment, the grip safety 26 comprises a grip lever 10 pivotally mounted to the frame at the thumb lever safety stud 31 and an expansion spring 33 which normally urges the grip lever outwardly. When grasped for normal firing the grip safety 26 pivots inwardly to a ledge on the frame 34 to allow full trigger and firing pin motion. The grip safety 26 depicted in FIG. 2 is of a type commonly known as the 'Beavertail' which, being longer and wider than certain other types, prevents 'hammer bite' of the web of the hand engaged with the grip and reduces felt recoil.

Referring still to FIG. 2, a sectional view of a pistol in which the present invention is embodied shows the firing pin 25 in a blocked position. A spring biased locking plunger 3 having a through bore 4 is perpendicularly movable relative to the direction of movement of the firing pin 25 and positively locks the firing pin 25 to prevent accidental firing. Such a plunger is presently used, for example, in the Smith & Wesson® Model 5906 traditional double action 9 mm pistol. In its normal locked position, the plunger is positioned as shown in FIG. 2, wherein the through bore 4 is not axially aligned with the firing pin 25, thus positively blocking movement of the firing pin.

In the present invention, intermediate lever 7 interposed between plunger 3 and grip safety lever 10 pivots on hammer stud 8 to reposition the plunger 3 to allow axial movement of the firing pin only when the grip safety 26 is properly depressed.

Figure 3:
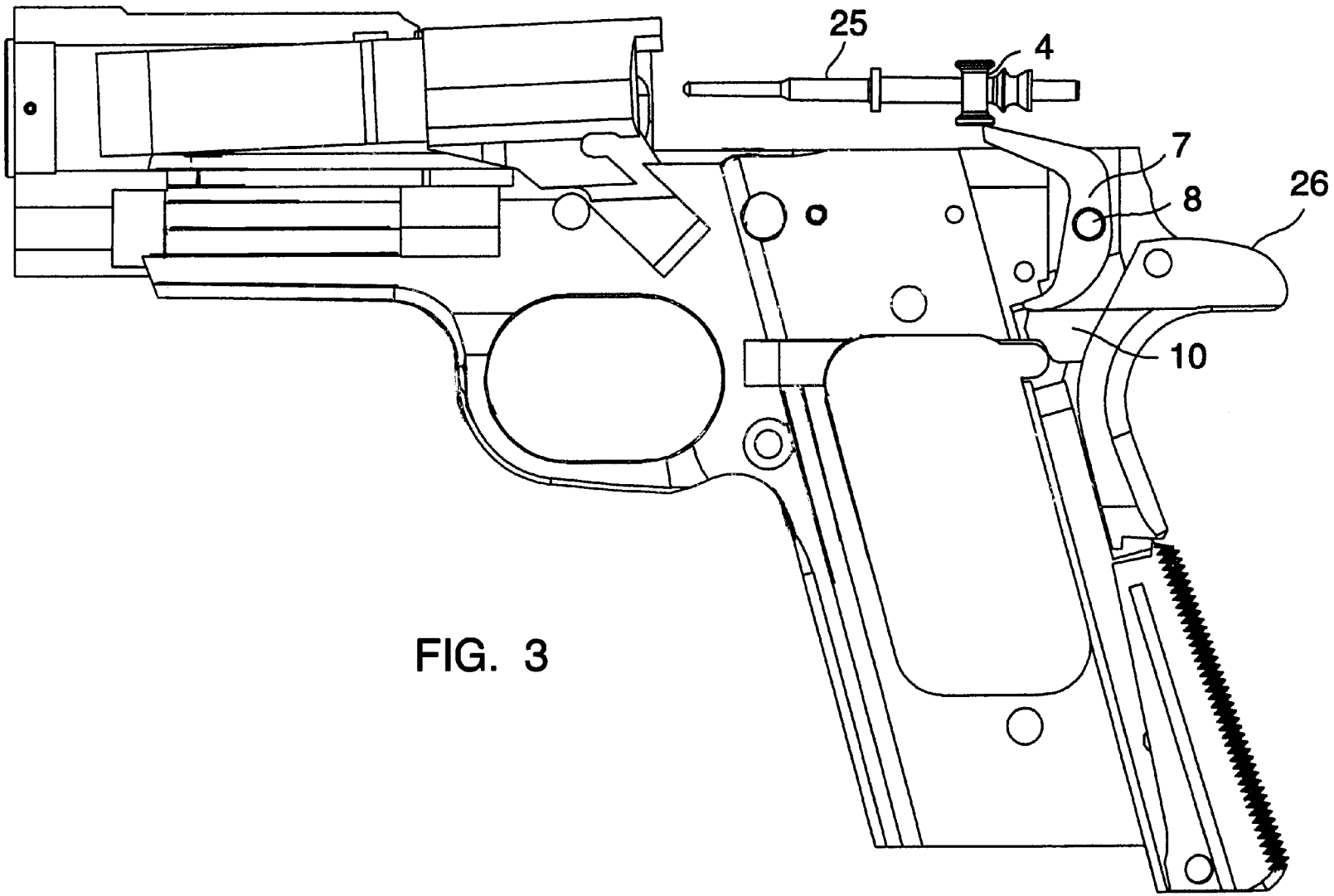
FIG. 3 is a side elevational view, partly in section, of the pistol of FIG. 1 in a "Ready to Fire" position.

In FIG. 3, the firing pin block of the present invention is shown in a 'Ready-to-Fire' position. With the grip safety 26 fully depressed, intermediate lever 7 pivots about the hammer stud 8 and presses against the spring biased plunger 3 to reposition the plunger to allow firing of the cartridge.

Referring still to FIGS. 2 and 3, the intermediate lever operably interposed between the grip safety lever and the locking plunger is preferably a unitary U-shaped part pivotally attached to the hammer stud, but it will be appreciated by those of ordinary skill in the art that other shapes and pivot points may be equally effective depending on the design of the firearm.

While the present invention has been illustrated and described with respect to a particular embodiment thereof, it should be appreciated by those of ordinary skill in the art, that various modifications to this invention may be made without departing from the spirit and scope of the present invention.

I claim:

1. A firearm comprising:

a frame having a grip portion;

a barrel mounted on the frame;

a reciprocating slide mounted to the frame;

a firing pin mechanism mounted in said slide for travel between firing and retracted positions;

a cockable hammer mounted on the frame at a hammer stud and adapted to strike the firing pin;

a trigger mechanism movably mounted to said frame for activating the firing pin;

a grip safety means pivotally mounted on said grip portion;

a spring biased locking plunger supported in said slide for reciprocating movement between a locked position preventing axial movement of said firing pin and a release position allowing axial movement of said firing pin; and an intermediate lever pivotally attached to the frame interposed between said grip safety means and said plunger for positioning said plunger in either a locked or unlocked position.

2. A firearm as in claim 1 wherein the intermediate lever is a unitary part.

3. A firearm as in claim 1 wherein said hammer is automatically reset after initial firing through reciprocal slide action.

4. A firearm comprising:

a frame having a grip portion;

a barrel mounted on the frame;

a reciprocating slide mounted to the frame;

a firing pin mechanism mounted in said slide for travel between firing and retracted positions;

a cockable hammer mounted on the frame at a hammer stud and adapted to strike the firing pin;

a trigger mechanism movably mounted to said frame for activating the firing pin;

a grip safety means pivotally mounted on said grip portion;

a spring biased locking plunger supported in said slide for reciprocating movement between a locked position preventing axial movement of said firing pin and a release position allowing axial movement of said firing pin; and an intermediate lever pivotally attached to the frame interposed between said grip safety means and said plunger for positioning said plunger in either a locked or unlocked position wherein said intermediate lever is pivotally mounted to said hammer stud.

* * * * *